United States Patent [19]

Schroeder

[11] 4,449,280

[45] May 22, 1984

[54] EXPLOSIVE TUBE EXPANSION

[75] Inventor: Joseph W. Schroeder, Clark, N.J.

[73] Assignee: Foster Wheeler Energy Corporation, Livingston, N.J.

[21] Appl. No.: 319,334

[22] Filed: Nov. 9, 1981

[51] Int. Cl.[3] ..... B23P 17/00; B21D 53/00

[52] U.S. Cl. ..... 29/421 E; 29/421 R; 29/157.4; 29/157.3 C

[58] Field of Search ..... 29/421 R, 421 E, 157.4, 29/153.3 C, 523; 72/56; 228/107, 183

[56] References Cited

U.S. PATENT DOCUMENTS

| | | | |
|---|---|---|---|
| 3,131,467 | 5/1964 | Traller | 72/56 |
| 3,409,969 | 11/1968 | Simons et al. | 72/56 |
| 3,411,198 | 11/1968 | Berman et al. | 29/523 |
| 3,426,681 | 2/1969 | Oliver | 29/157.4 |
| 3,503,110 | 3/1970 | Berry et al. | 29/157.4 |
| 3,543,370 | 12/1970 | Berman et al. | 29/157.4 |
| 3,557,589 | 1/1971 | Schwarz | 72/56 |
| 3,661,004 | 5/1972 | Lee et al. | 29/421 E |
| 3,672,035 | 6/1972 | Lieberman | 29/421 E |
| 3,717,925 | 2/1973 | Hardwick | 29/157.4 |
| 3,868,131 | 2/1975 | Zondag | 29/157.4 |
| 3,939,681 | 2/1976 | Yoshitomi et al. | 72/56 |
| 3,993,001 | 12/1976 | Hawes | 29/157.4 |
| 4,030,419 | 6/1977 | Loch | 29/157.4 |
| 4,117,966 | 10/1978 | Green et al. | 29/157.4 |

FOREIGN PATENT DOCUMENTS

| | | | |
|---|---|---|---|
| 1584451 | 11/1976 | United Kingdom | 228/107 |
| 0703192 | 4/1978 | U.S.S.R. | 29/421 E |

*Primary Examiner*—Howard N. Goldberg
*Assistant Examiner*—Steven Nichols
*Attorney, Agent, or Firm*—Marvin A. Naigur; John E. Wilson; Thomas L. Adams

[57] ABSTRACT

Apparatus for expanding a tube within a tube sheet has an insert and a detonation device. The insert is sized to fit coaxially within the tube. The detonation device encircles the insert and can produce upon detonation an explosive force. Also included is an annular buffer sized to fit between the tube and the detonation device. In operation, the tube is inserted into a tube hole of the tube sheet. The insert is coaxially positioned within the tube and within the tube hole. The insert is overlayed with an explosive layer and the buffer is interposed between the explosive layer and the tube. The tube is joined to the tube sheet by detonating the explosive layer.

9 Claims, 3 Drawing Figures

EXPLOSIVE TUBE EXPANSION

BACKGROUND OF THE INVENTION

The present invention relates to joining tubes to a tube sheet and, in particular, to explosive expansion of the tubes within tube holes.

The concept of expanding tubes in tube sheets is not new. For low pressure use, tubes have been mechanically expanded within tube sheet holes and frequently this is all that is needed to hold the tubes within the tube sheet. Frequently, circular or longitudinal grooves are made in the wall of the holes and the tubes are expanded into the grooves to obtain a more effective grip on the tubes. In high pressure work, it is customary to weld the tube ends to the tube sheet, and then expand the tubes in the area of overlap between the tubes and tube sheet, for the purpose of avoiding crevices in which corrosive materials can lodge.

It is also known to expand a tube within a tube sheet by employing a cylindrical, polyethylene insert having an axial bore filled with an explosive charge (U.S. Pat. No. 3,411,198). This insert is placed inside a tube positioned within a tube sheet, the outside of the insert being surrounded by a buffering sleeve also of polyethylene. The foregoing expansion technique has been found to operate satisfactorily for tube sheets which are many times thicker than the diameter of the tube being joined to the sheet. This known technique takes advantage of the relatively long piece of tube contained within the sheet to develop a tapering effect. Specifically, the amount of expansion occurring at either end of the polyethylene insert is lessened since the material of the insert has a propensity to extrude axially at its ends.

It is also known to join sections of pipe by inserting them into a connecting sleeve encircling the joint. A turn of detonating cord is wrapped around each end of the connecting sleeve and detonated to swage inwardly the sleeve and bind it to the two sections of pipe. However, this technique basically does not concern outwardly directed, radial deformation as is required to join a tube to a tube sheet. Furthermore, this known technique fails to include a buffer for transmitting energy and protecting the work-pieces from damage.

Still another explosive expansion technique is shown in U.S. Pat. No. 3,543,370.

Accordingly, there is need for an efficient apparatus and method for joining tubes to a tube sheet through an explosive expansion. This technique ought to be suitable for joining large diameter tubes to a relatively thin tube sheet.

SUMMARY OF THE INVENTION

In accordance with the illustrative embodiment demonstrating features and advantages of the present invention, there is provided apparatus for expanding a tube within a tube sheet. The apparatus has an insert, an annular buffer and a detonation means. The insert is sized to fit coaxially within the tube. The detonation means encircles the insert and is operable to produce upon detonation an explosive force. The annular buffer is sized to fit between the tube and the detonation means.

Also, in accordance with a related method of the present invention, tubes are expanded within a tube sheet by employing an insert, a buffer and an explosive layer. The method includes the step of inserting the tube into a tube hole of the tube sheet. The insert is coaxially positioned within the tube and within the tube hole. The method also includes the step of overlaying the insert with the explosive layer. The buffer is interposed between the explosive layer and the tube. The tube is expanded by detonating the explosive layer.

By employing such apparatus and methods, a relatively simple joint is formed between a tube and a tube sheet with an explosive layer mounted upon an insert. A strong joint can be thus formed in a relatively thin tube sheet to a relatively large tube.

Preferably, the tube hole may contain interior, concentric grooves into which the tube is pushed by the explosive force. This feature provides a more positive locking at the joint between the tube and tube sheet. To facilitate such locking, the explosive layer may be a detonating cord such as Primacord which is wound around the insert. A large charge may be wound on the insert proximate the grooves in the tube hole. This non-uniform charge will ensure that the tube is sufficiently deformed so as to extrude into the grooves of the tube hole and form a strong joint.

Furthermore, for embodiments where the tube itself containes a coaxial pipe, the insert can have a concentric bore for receiving the coaxial pipe. This allows simple assembly and installation of the tube even in the presence of the coaxial pipe.

A buffer encircling the explosive layer, preferably formed of plastic material such as polyethylene, prevents damage to the workpiece. In the kinetic expansion provided by the invention essentially all of the explosive energy is radially transmitted through the polyethylene medium and the energy loss therein is minimal. Also, the polyethylene medium ensures that the explosive force is applied across the entire joint without significant gaps during the forming process. Following the expansion of the tubes, the plastically expanded explosive buffers can contract to their original shape and are therefore easily removable.

BRIEF DESCRIPTION OF THE DRAWINGS

The above brief description as well as other objects, features and advantages of the present invention will be more fully appreciated by reference to the accompanying drawings wherein.

DETAILED DESCRIPTION OF THE PREFERRED EMBODIMENT

Figure 1:
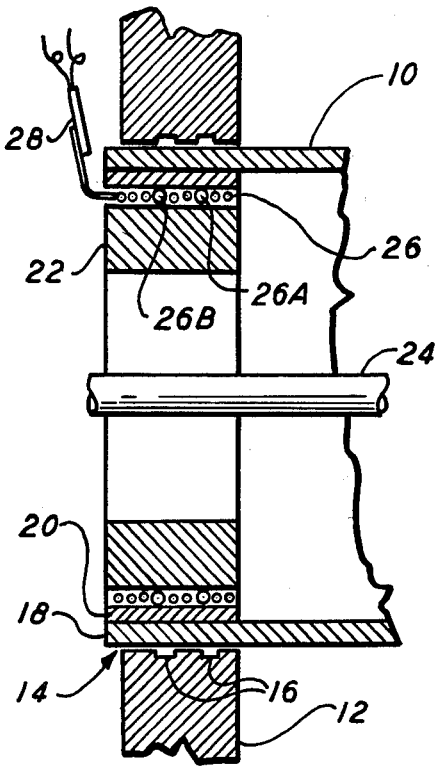
FIG. 1 is a longitudinal, sectional view of the apparatus according to the teachings of the present invention.
Figure 3:
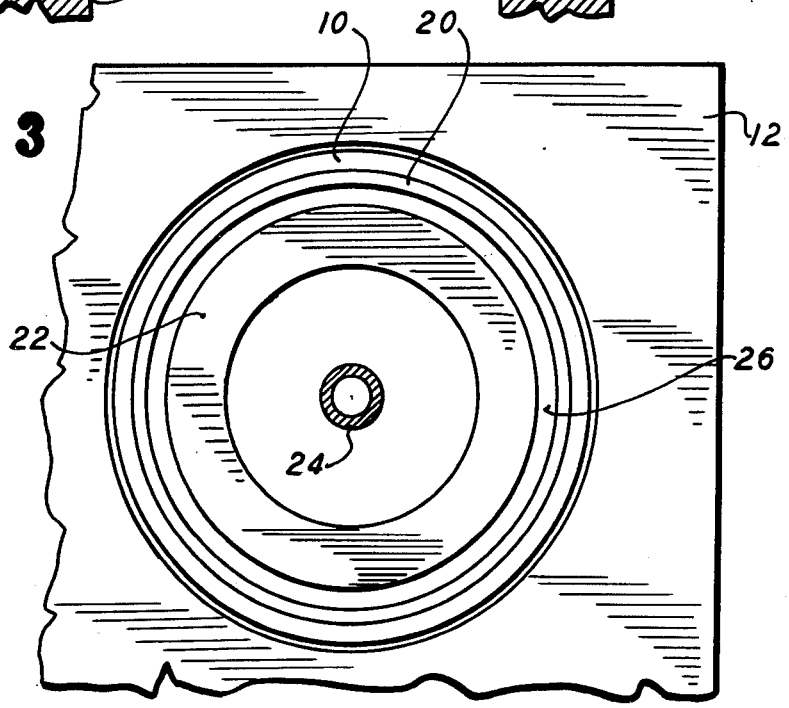
FIG. 3 is an end view of the apparatus of FIG. 1.

Referring to FIGS. 1 and 3, a tube 10 is shown coaxially mounted within a tube sheet 12 having a plurality of tube holes, one such hole being shown as grooved aperture 14 having grooves 16. It will be appreciated that in some embodiments, grooves 16 may be deleted but are preferred since they increase the strength of the joint to tube 10. Also, in some embodiments, tube 10 can be welded at its end 18 to the face of tube sheet 12 to form a preliminary joint, although such welding is not required in all embodiments. The tube sheet can be carbon steel or it can be cladded with a nickel alloy or stainless steel. Tube 10 can be a carbon steel, stainless steel or an alloy such as copper-nickel or Monel. Generally, tube 10 is inserted within tube sheet 12 with a radial clearance of about 0.006 inches, plus or minus. The diameter of tube 10 was in one embodiment six inches with ¼ inch wall thickness, although other dimensions are expected depending upon the application. The thickness of tube sheet 12 for the foregoing embodiment was one inch, although again, other dimensions are contemplated. It is significant to note that the diameter of tube 10 is six times greater than the thickness of tube sheet 12.

Annular buffer 20 is shown herein as a band of plastic sized to fit snugly against the inside wall of tube 10. For example wherein tube sheet 12 was 1 inch thick, buffer 20 was selected to be between 1.375 to 1.5 inch long but other lengths are contemplated. Preferably, the axial length of buffer 20 is sized so it is coterminous with end 18 of tube 10 and extends within tube 10 to a position even with the far side of tube sheet 12. In one embodiment, buffer 20 was ⅛ inch thick but can vary depending upon each application. Preferably, buffer 20 is formed of polyethylene or another thermoplastic hardenable resin having properties the same as or similar to polyethylene. Suitable mediums other than polyethylene are polyvinyl acetals, polyvinyl butyrals, polystyrene, nylon, Teflon, polyester resins, Delrin, Lexan, polypropylene, Tygon, etc. The important properties of this material for the purpose of this invention are defined as follows:

Melting point. - A problem with wax or other easily melted materials is that it melts following explosion and adheres to the inside surfaces of tube 10. With polyethylene, only a small residue of material is left on the inside surface of tube 10, and this residue is easily wire-brushed from the tubes. The plastic chosen should leave no substantial residue, as a large number of tubes usually are involved, making cleaning an important consideration.

Flexibility - The material ought to maintain its dimensions, although bent briefly as may be required to route the material around obstructions.

Formability. - The force transmitting medium must be hardenable and capable of being machined or extruded to close tolerances, less than about 1/16 (0.060) inch. In this respect, easy insertion within tube 10 is a criterion, but the fit with the tube cannot be too loose. In the case of carbon steel tubes, buffer 20 can make a relatively loose fit with the inside of tube 10, up to 1/16 of an inch. However, with harder tube materials, such as copper and nickel, the expansion must be more closely controlled (because of the higher yield point in the tubes and in the tube sheet) requiring tolerances of approximately 0.010 inch between buffer 20 and the tube inside surface.

Mold shrinkage preferably is small (0.02–0.05 inch per inch) to obtain desired tolerances.

Resiliency. - Buffer 20 expands outwardly against tube 10, and somewhat further as the tube expands. It must be capable of withstanding approximately a 20% strain (change in radius per unit of radius) without substantial fracture or rupture, and be further capable of returning to approximately the original dimensions.

Density. - The material preferably is approximately the density of polyethylene to transmit effectively the explosive force.

Miscellaneous. - The material ought to be inert with respect to tube 10 and tube sheet 12, ought to be generally water and solvent resistant, inflammable and have such other obviously beneficial characteristics. Other requirements for buffer 20 can be made. For instance, with certain materials, tube sheet 12 is maintained at what is called a "nulductility" temperature, up to perhaps 130° F., the temperature at which transition from ductile to brittle for the metal occurs. In such instances, buffer 20 must maintain its integrity.

An insert 22 is shown coaxially mounted within tube 10. Insert 22 is an annular device having an outside diameter smaller than the inside diameter of buffer 20. In one embodiment, the gap between buffer 20 and insert 22 was ⅛ inch but can be altered in other embodiments. Insert 22 can be formed of steel, plastic or other material capable of sustaining the explosive shock generated in a manner to be described hereinafter. Centered within tube 10 is a pipe 24 which leads through the concentric bore of insert 22. It will be appreciated that in embodiments where pipe 24 is not employed, insert 22 may be in the form of a solid disc.

A detonation means is shown herein as detonating cord 26 which is wound around insert 22 and which leads to an electrically triggerable detonator 28. Being thus wound, detonating cord 26 forms an explosive layer containing a predetermined number of grains of explosive, generally 25 to 40 grains per foot, along the length of the cord. A detonating cord known commercially as Primacord can be used and it consists of grains of explosive embedded in a fiber or plastic body. The Primacord can be manufactured with any desired diameter, within limits, simply by varying the ratio of carrier material to grains of explosive. Charge concentration as low as four grains per foot can be obtained.

In this embodiment, the detonating cord is non-uniform. In particular, turns 26A and 26B are sections of detonating cord having a larger diameter and also containing a greater amount of explosives per linear foot. Consequently, upon detonation, greater force will be generated in the vicinity of turns 26A and 26B for the purposes described hereinafter.

To facilitate an understanding of the principles associated with the foregoing apparatus, its method of use will now be described. Initially, tube 10 is inserted within tube sheet 12 with its free end 18 extending beyond tube sheet 12 about ⅜ to ½ inch, preferably. It will be appreciated that this dimension can be varied depending upon the particular application. Although not performed herein, tube 10 can be preliminarily welded at end 18 to tube sheet 12. Also, buffer 20 is fitted within tube 10 with its outer end adjacent free end 18 of tube 10. It will be noted that the other end of buffer 20 is in the same plane as the far surface of tube sheet 12. Insert 22 is installed together with detonating cord 26. The larger turns 26A and 26B of the detonating cord are positioned adjacent to grooves 16. It will be appreciated that the foregoing components can be readily installed within tube 10 since there is no interference with internal pipe 24.

Figure 2:
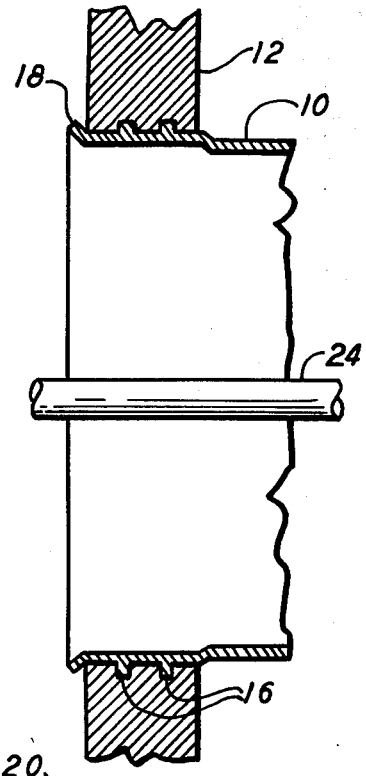
FIG. 2 is a longitudinal, sectional view of the apparatus of FIG. 1 after explosive forming.

After detonator 28 is installed to a free end of cord 26 and the blast site has been cleared, an electrical charge is applied to detonator 28 to detonate cord 26. Consequently, a violent shock wave bears against insert 22 and buffer 20 driving the latter radially outward and causing tube 10 to engage and be deformed by tube sheet 12 and its grooves 16. Because of the extremely high pressures involved, the tube 10 is so deformed that it acts somewhat like a liquid as it engages and seals itself to tube sheet 12. The resulting joint is illustrated in FIG. 2 showing that grooves 16 have been filled with extruded material from tube 10 thus providing a positive interlocking between it and tube sheet 12. Also, free end 18 of tube sheet 12 has flared outwardly further increasing the joint strength. While flaring was described, for appropriate embodiments, end 18 of tube 10 as well as its contained buffer 20 can be kept flush with the near surface of tube sheet 12, in which case no flaring occurs. It will also be appreciated that buffer 20 (FIG. 1) is easily removable, since it is made of polyethylene or similar material which contracts after detonation and does not tend to stick to the inside surface of tube 10.

It is to be appreciated that various modifications may be implemented with respect to the above described preferred embodiment. For example, the number of grooves employed on the interior surface of the tube holes can be greater or fewer than that illustrated. Furthermore, as previously mentioned, some embodiments will not employ any grooves on the tube holes. Of course, the various dimensions of the workpieces, the tubes and tube sheets, will vary and depend upon the particular devices being assembled. The concentration of the explosive charge will depend upon the desired joint strength, ductility of the workpieces, the existence of grooving, etc. Also, while a solid or bored disc is described herein as an insert, the particular shape chosen can be altered to fit the particular workpieces, which may have a non-circular cross section, a taper or other shape. Furthermore, various materials may be substituted depending upon the desired strength, weight, integrity, corrosion resistance, etc.

Obviously, many modifications and variations of the present invention are possible in light of the above teachings and it is therefore to be understood that within the scope of the appended claims, the invention may be practiced otherwise than as specifically described.

What is claimed is:

1. Apparatus for expanding a tube within a tube sheet comprising:

an insert sized to fit coaxially within said tube;

detonation means encircling said insert and operable to produce upon detonation an explosive force; and an annular buffer sized to fit between said tube and said detonation means, said buffer having an axial length comparable to the thickness of said tube sheet and sized and positioned to avoid bulging of said tube beyond at least one side of said tube sheet, said buffer being a band of plastic material having an axial length equivalent to that of said detonation means.

2. Apparatus according to claim 1 wherein said buffer is a band of thermoplastic hardenable resin of the class consisting of polyethylene and resins having essentially the same flexibility, density and at least about as high a melting point.

3. Apparatus according to claim 1 wherein said insert and said buffer overlap said tube sheet to about the same extent.

4. A method for expanding tubes within a tube sheet with an insert, an annular buffer and an explosive layer, comprising the steps of:

inserting said tube into a tube hole of said tube sheet, said tube hole having an interior, concentric groove;

coaxially positioning said insert within said tube and within said tube hole;

overlaying said insert with said explosive layer, said explosive layer comprising a detonating cord installed by winding it around said insert;

positioning a section of said cord having a higher number of grains of explosive alongside said groove;

interposing said buffer between said explosive layer and said tube with at least one side of said buffer approximately even with one side of said tube sheet; and detonating said explosive layer.

5. Apparatus for expanding a tube within a tube sheet, the diameter of said tube being at least twice the thickness of said tube sheet, comprising:

an insert sized to fit coaxially within said tube;

detonation means encircling said insert and operable to produce upon detonation an explosive force; and an annular buffer sized to fit between said tube and said detonation means, said buffer having an axial length comparable to the thickness of said tube sheet and sized and positioned to avoid bulging of said tube beyond at least one side of said tube sheet, said tube sheet having at least one grooved aperture sized to receive said tube and wherein said detonation means comprises: means for producing said explosive force nonuniformly and concentrating said force on said aperture into its groove.

6. Apparatus according to claim 5 wherein said detonation means comprises detonating cord spirally wound on said insert, larger size cord being positioned adjacent the groove of said aperture.

7. Apparatus for expanding a tube within a tube sheet, the diameter of said tube being at least twice the thickness of said tube sheet, comprising:

an insert sized to fit coaxially within said tube, said insert having an annular shape;

detonation means encircling said insert and operable to produce upon detonation an explosive force; and an annular buffer sized to fit between said tube and said detonation means, said buffer having an axial length ccmparable to the thickness of said tube sheet and sized and positioned to avoid bulging of said tube beyond at least one side of said tube sheet.

8. A method for expanding tubes within a tube sheet with an insert, an annular buffer and an explosive layer, comprising the steps of:

inserting said tube into a tube hole of said tube sheet;

positioning the free end of said tube inserted into said tube hole to extend beyond said sheet by an extent allowing flaring of said free end;

coaxially positioning said insert within said tube and within said tube hole;

overlaying said insert with said explosive layer;

aligning said insert and said explosive layer so each is coterminous with said free end of said tube;

interposing said buffer between said explosive layer and said tube with at least one side of said buffer approximately even with one side of said tube sheet; and detonating said explosive layer.

9. A method for expanding tubes within a tube sheet with an insert having a coaxial bore, an annular buffer and an explosive layer, comprising the steps of:

inserting said tube into a tube hole of said tube sheet, said tube containing a coaxial pipe;

coaxially positioning said insert within said tube and within said tube hole and encircling said pipe with said insert;

overlaying said insert with said explosive layer;

interposing said buffer between said explosive layer and said tube with at least one side of said buffer approximately even with one side of said tube sheet; and detonating said explosive layer.

* * * * *